US011244657B2

(12) United States Patent
Chen

(10) Patent No.: US 11,244,657 B2
(45) Date of Patent: Feb. 8, 2022

(54) DISPLAY SYSTEM AND DISPLAY METHOD THEREOF

(71) Applicant: Qisda Corporation, Taoyuan (TW)

(72) Inventor: Wei-Jou Chen, Hsinchu County (TW)

(73) Assignee: Qisda Corporation, Taoyuan (TW)

( * ) Notice: Subject to any disclaimer, the term of this patent is extended or adjusted under 35 U.S.C. 154(b) by 0 days.

(21) Appl. No.: 16/902,328

(22) Filed: Jun. 16, 2020

(65) Prior Publication Data

US 2020/0410961 A1 Dec. 31, 2020

(30) Foreign Application Priority Data

Jun. 26, 2019 (TW) ..... 108122390

(51) Int. Cl.
*G09G 5/373* (2006.01)
*G09G 5/377* (2006.01)

(52) U.S. Cl.
CPC ..... *G09G 5/373* (2013.01); *G09G 5/377* (2013.01); *G09G 2320/066* (2013.01); *G09G 2320/0626* (2013.01); *G09G 2320/0666* (2013.01); *G09G 2320/08* (2013.01); *G09G 2340/045* (2013.01); *G09G 2340/0407* (2013.01); *G09G 2340/12* (2013.01); *G09G 2354/00* (2013.01); *G09G 2370/04* (2013.01)

(58) Field of Classification Search
CPC ..... G09G 5/373; G09G 5/377; G09G 2320/0626; G09G 2320/066; G09G 2320/0666; G09G 2320/08; G09G 2340/0407; G09G 2340/045; G09G 2340/12; G09G 2354/00; G09G 2370/04
See application file for complete search history.

(56) References Cited

U.S. PATENT DOCUMENTS 7,339,516 B2 * 3/2008 Thompson ..... G01S 7/22 342/179
2010/0134513 A1 * 6/2010 Yui ..... G09G 5/00 345/589
2011/0063422 A1 * 3/2011 Yoo ..... H04N 21/816 348/54
2011/0193898 A1 * 8/2011 Kim ..... G09G 5/003 345/698

FOREIGN PATENT DOCUMENTS

CN 102595242 A 7/2012
CN 102662566 A 9/2012

OTHER PUBLICATIONS

Office action of counterpart application by Taiwan IP Office dated Mar. 17, 2020.

* cited by examiner

*Primary Examiner* — Antonio A Caschera

(57) ABSTRACT

A display system includes a display device and a host. The host is separately disposed on the display device and connected to the display device through a wireless or wired manner. The host transmits an image signal to the display device. The display device is configured to display a frame according to the image signal and enlarge a local portion of the frame.

19 Claims, 6 Drawing Sheets

DISPLAY SYSTEM AND DISPLAY METHOD THEREOF

This application claims the benefit of Taiwan application Serial No. 108122390, filed Jun. 26, 2019, the subject matter of which is incorporated herein by reference.

BACKGROUND OF THE INVENTION

Field of the Invention

The present disclosure relates to a display system and a display method thereof, and more particularly to a display system configured to enlarge a local portion and a display method thereof.

Description of the Related Art

Conventional screen display methods usually involve the host processing the relevant part of the original image signal, and then directly transmitting the processed image signal to the display device. After receiving the processed image signal, the display device displays a screen according to the processed image signal. However, processing the original image signal causes an additional burden on the host. Based on this, the industry has made every effort to develop display methods that can reduce the burden on the host.

SUMMARY OF THE INVENTION

The invention is directed to a display system capable of resolving the abovementioned problems encountered in the prior art.

According to an embodiment of the present invention, a display system is provided. The display system includes a display device and a host. The host is separately disposed from the display device, wherein the host is connected to the display device through a wireless method or wired method, wherein the host is configured to transmit an image signal to the display device. The display device is configured to display a frame according to the image signal and enlarge a local portion of the frame.

According to another embodiment of the present invention, a display method of a display system is provided. The display system includes a display device and a host separately disposed from the display device. The display method includes the following steps. An image signal is transmitted to the display device by the host; and a frame is displayed according to the image signal and enlarging a local portion of the frame.

According to an embodiment of the present invention, a display system is provided. The display system includes a display device, a host and an input device. The host is connected to the display device with an audio-visual transmission line, wherein the host is configured to transmit an image signal to the display device through the audio-visual transmission line, the display device is configured to display a frame according to the image signal, and the frame has a first crosshair pattern. The input device is connected to the host and configured to input a setting instruction to the host, wherein the host transmit the setting instruction to the display device through the audio-visual transmission line, the display device is configured to enlarge a local portion according to the setting instruction, and the local portion has a second crosshair pattern.

The above and other aspects of the invention will become better understood with regard to the following detailed description of the preferred but non-limiting embodiment(s). The following description is made with reference to the accompanying drawings.

DETAILED DESCRIPTION OF THE INVENTION

Figure 1:
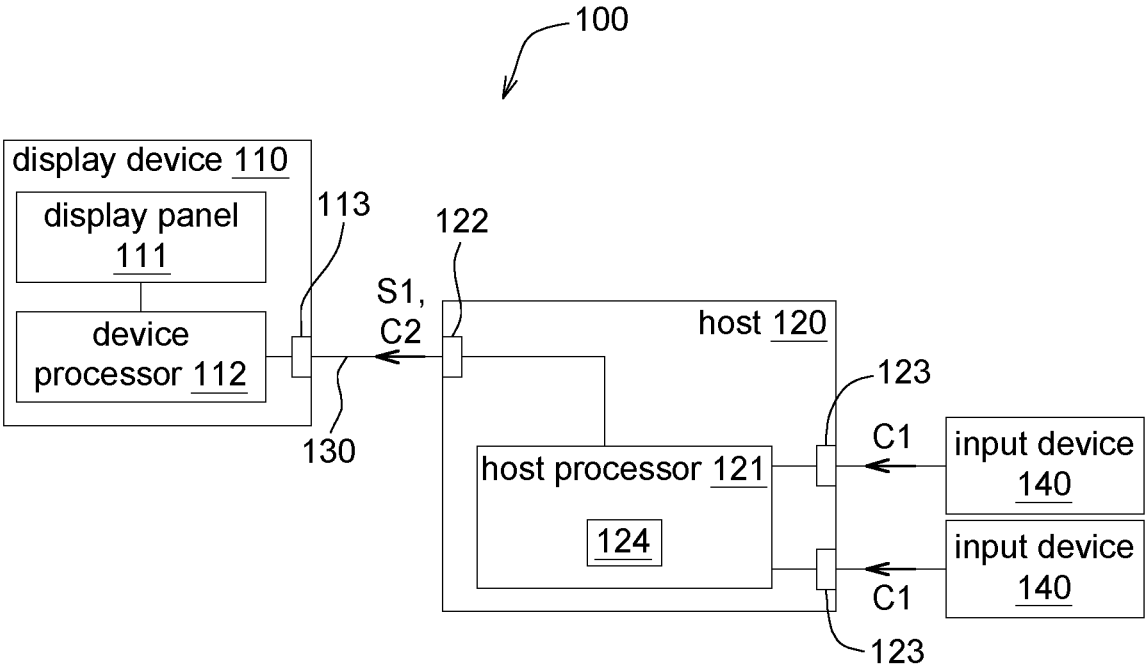
FIG. 1 shows a functional block diagram of a display system according to an embodiment of the present invention.
Figure 2:
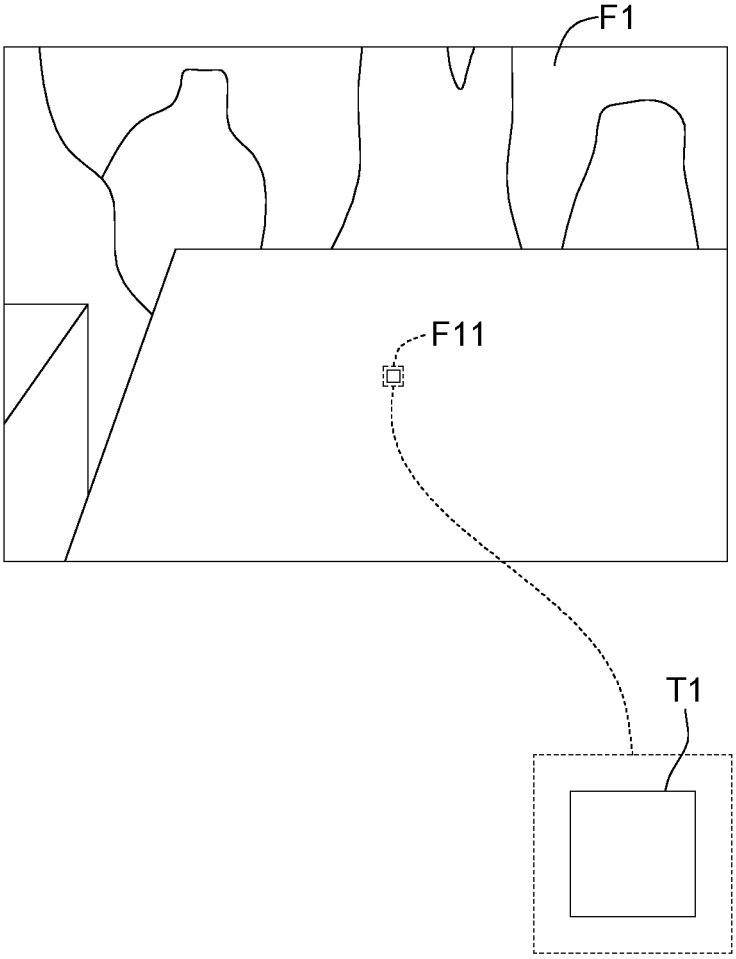
FIG. 2 shows a schematic diagram of a display panel of FIG. 1 displaying a frame F1 (a local portion has not been enlarged) based on an image signal S1.
Figure 3:
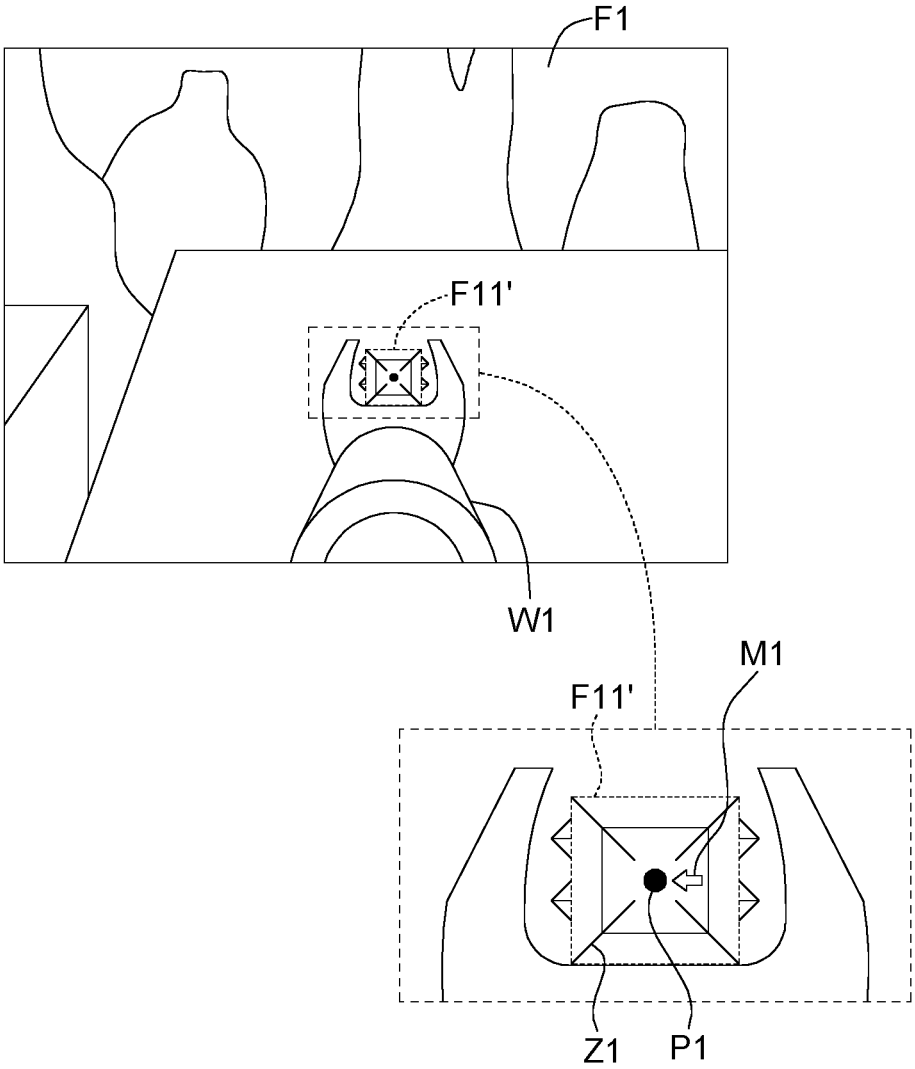
FIG. 3 shows an enlarged diagram of the local portion F11 of FIG. 2.

Referring to FIGS. 1 to 3, FIG. 1 shows a functional block diagram of a display system 100 according to an embodiment of the present invention, FIG. 2 shows a schematic diagram of a display panel 111 of FIG. 1 displaying a frame F1 (a local portion F11 has not been enlarged) based on an image signal S1, and FIG. 3 shows an enlarged diagram of the local portion F11 of FIG. 2.

The display system 100 includes a display device 110, a host 120, an audio-visual transmission line 130 and at least one input device 140. The host 120 is separately disposed from the display device 110, and the host 120 and the display device 110 could be connected through a wireless or wired technology. This embodiment is described by using a wired technology as an example. The host 120 could send the image signal S1 to the display device 110. The display device 110 is configured to display the frame F1 and enlarge the local portion F11 of the frame F1 according to the image signal S1.

Furthermore, as shown in FIG. 2, the display device 110 displays the frame F1 according to the image signal S1, and the local portion F11 has not enlarged. As shown in FIG. 3, the display device 110 enlarges the local portion F11 (shown in FIG. 2) into a local enlarged frame F11'. Since the action of enlarging the frame is performed by the display device 110, the burden on the host 120 could be reduced. In the present embodiment, the host 120 transmits the original image signal S1 to the display device 110. After the display device 110 receives the image signal S1, the display device 110 processes the image signal S1 or the frame F1 according to the frame display requirements (or settings) to frame effect required (or set) by of the local portion F11. In addition, since the display device 110 processes the image signal S1 or the frame F1, in a network game environment connected with the host, the signal transmitted to another display device (for example, a remote display via live broadcast) by the host 120 is still original image signal S1, wherein the another display device does not display the local enlarged frame F11'. In other words, the viewer cannot know the change of the local portion F11 from the another display device, and the user using the display device 110 could use the local enlarged frame F11' to perform finer operations. In addition, the host 120 is an electronic device, for example, a computer host or a server that does not include a display screen.

As shown in FIG. 3, the local enlarged frame F11' has a first crosshair pattern Z1. The first crosshair pattern Z1 has a crosshair position P1. The crosshair position P1 could be transmitted to the display device 110 by the host 120 through the audio-visual transmission line 130, or a fixed position (for example, center in the frame) could be set by an input interface (for example, the OSD or the touch screen) of the display device 110. The display device 110 determines the range scope of the local enlarged frame F11' (or the local portion F11) with the crosshair position P1 as the center. In the present embodiment, the crosshair position P1 is, for example, the center point position (fixed position) of the frame, but it could also be dynamically changed with cursor position. In addition, the local enlarged frame F11' in FIG. 3 takes a rectangle as an example, but it could also be a triangle, a circle, or an oval.

In an embodiment, the local enlarged frame F11' could be a proportional enlargement of the local portion F11 (for example, the magnification ratio of the length and the magnification ratio of width of the local portion F11 is equal). Alternatively, the magnification ratio of the length and the magnification ratio of the width could be different. In addition, the aforementioned magnification ratio is, for example, between 1.1 times and 4 times, but it could be larger or smaller.

In addition, the image signal S1 is, for example, signal of still frame or a video stream signal (animated frame). In addition, the image signal S1 is, for example, an image signal generated when the host 120 loads a program, which is the image signal provided by the source code of the program. In addition, the aforementioned programs are, for example, computer game software or other types of software.

As shown in FIG. 1, the display device 110 includes a display panel 111, a device processor 112, and a device port 113. The host 120 includes a host processor 121, a first host port 122 and at least one second host port 123. As shown in the figure, the display device 110 and the host 120 are connected through the audio-visual transmission line 130. For example, the audio-visual transmission line 130 connects the device port 113 of the display device 110 with the first host port 122 of the host 120. The audio-visual transmission line 130 is, for example, a High Definition Multimedia Interface (HDMI), a Display Port (DP), a Video Graphics Array (VGA) or audio-visual transmission line with other display interface specifications. The host processor 121 of the host 120 is configured to load the foregoing program, and is configured to transmit the image signal S1 based on the program to the display device 110 through the audio-visual transmission line 130. The device processor 112 of the display device 110 is configured to display the frame F1 and enlarge the local portion F11 of the frame F1 according to the image signal S1.

The method of the display device 110 enlarging the local portion F11 of the frame F1 is, for example, that the device processor 112 first captures the local portion F11 of the frame F1, and then the device processor 112 enlarges the local portion F11 (the local portion F11 is shown in the FIG. 2) to the local enlarged frame F11' (local enlarged frame F11' is shown in FIG. 3). Since the local enlarged frame F11' is an enlarged frame, and thus its resolution is lower than that of the local portion F11 (before being enlarged). Then, the device processor 112 superimposes the local enlarged frame F11' on the local portion F11 of the frame F1, wherein the resolution of the local enlarged frame F11' is lower than that of the area outside the local enlarged frame F11'.

In another embodiment, when the display device 110 enlarges the local portion F11 of the frame F1, the host processor 121 of the host 120 lowers, in the image signal S1, a moving speed of a cursor M1 (the cursor M1 is shown in FIG. 3) of the local enlarged frame F11'. As a result, the operator could more accurately move the cursor M1 to a desired position in the local enlarged frame F11'.

Figure 4:
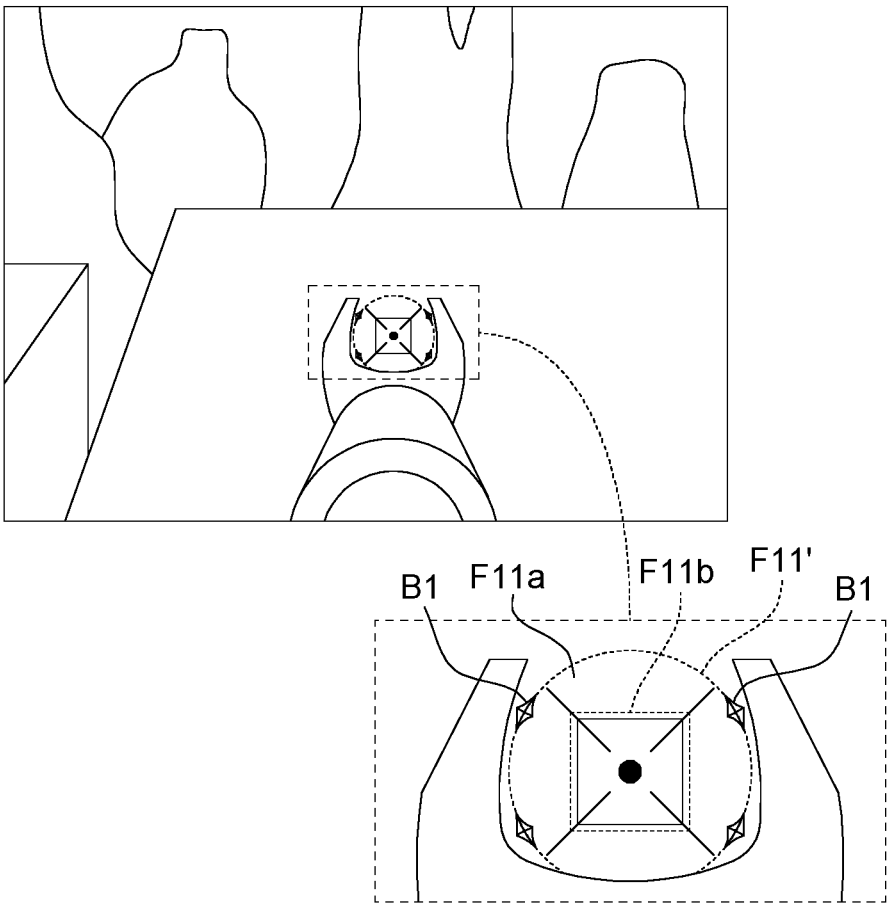
FIG. 4 shows a schematic diagram of another enlargement manner for the local portion F11 in FIG. 2.

Referring to FIG. 4, FIG. 4 shows a schematic diagram of another enlargement manner for the local portion F11 in FIG. 2. The local enlarged frame F11' includes an edge region F11*a* and a middle region F11*b*. In an embodiment, the display device 110 first captures the local portion F11 of the frame F1 in FIG. 2 having the same size or the same content as the local enlarged frame F11' in FIG. 3, and uses the scale ratio of the edge region F11*a* being, for example, less than 1 (i.e., shrink), and the scale ratio of the middle region F11*b* being, for example, greater than 1 (i.e., enlarge) to process the captured frame to obtain the local enlarged frame F11', and then it is pasted back to the captured region in the frame F1. In the present embodiment, the scale ratio of the edge region F11*a* of the local enlarged frame F11' is different from the scale ratio of the middle region F11*b*. For example, the scale ratio of the edge region F11*a* is smaller than the scale ratio of the middle region F11*b*. In an embodiment, the scale ratio of the local enlarged frame F11' gradually increases from the edge region F11*a* to the middle range F11*b*. As a result, as shown in FIG. 4, the background B1 behind the target T1 in the edge region F11*a* of the superimposed local enlarged frame F11' could be displayed, so that the operator could observe the existence of the background B1. In an embodiment, the scale ratio of the local enlarged frame F11' gradually increases from the edge range F11*a* to the middle range F11*b*.

Figure 5:
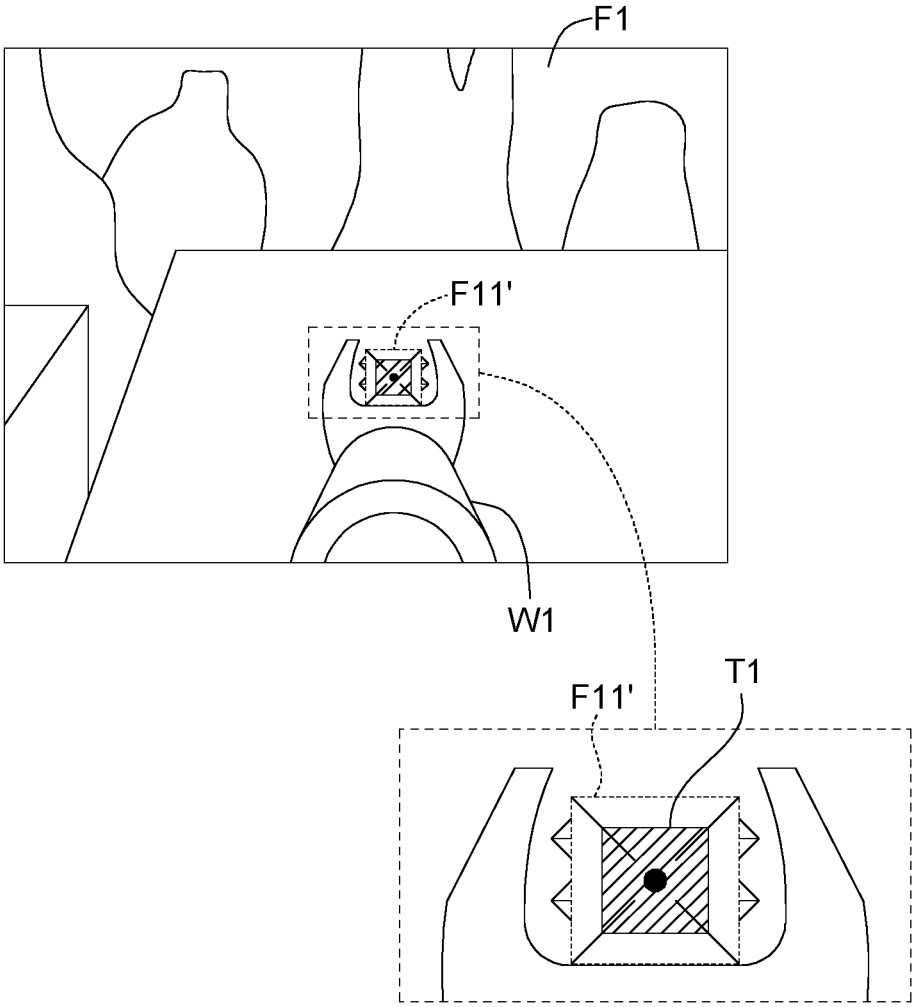
FIG. 5 shows a schematic diagram of another enlargement manner of the local portion F11 in FIG. 2.

Referring to FIG. 5, FIG. 5 shows a schematic diagram of another enlargement manner of the local portion F11 in FIG. 2. The device processor 112 of the display device 110 could determine whether the local portion F11 has the target T1. When the local portion F11 has the target T1, the device processor 112 could change the display parameter of the target T1 of the local enlarged frame F11', such as the contrast, color and/or brightness of the target T1 (the target T1 in FIG. 5 indicates the change of the display parameter with diagonal lines), such that the difference between the target T1 and its surroundings could be increased. In addition, the target T1 is, for example, a feature of a specific shape of the frame F1 or color of the frame F1. For a software game, the target T1 is, for example, a specific blocking target in software game.

Figure 6:
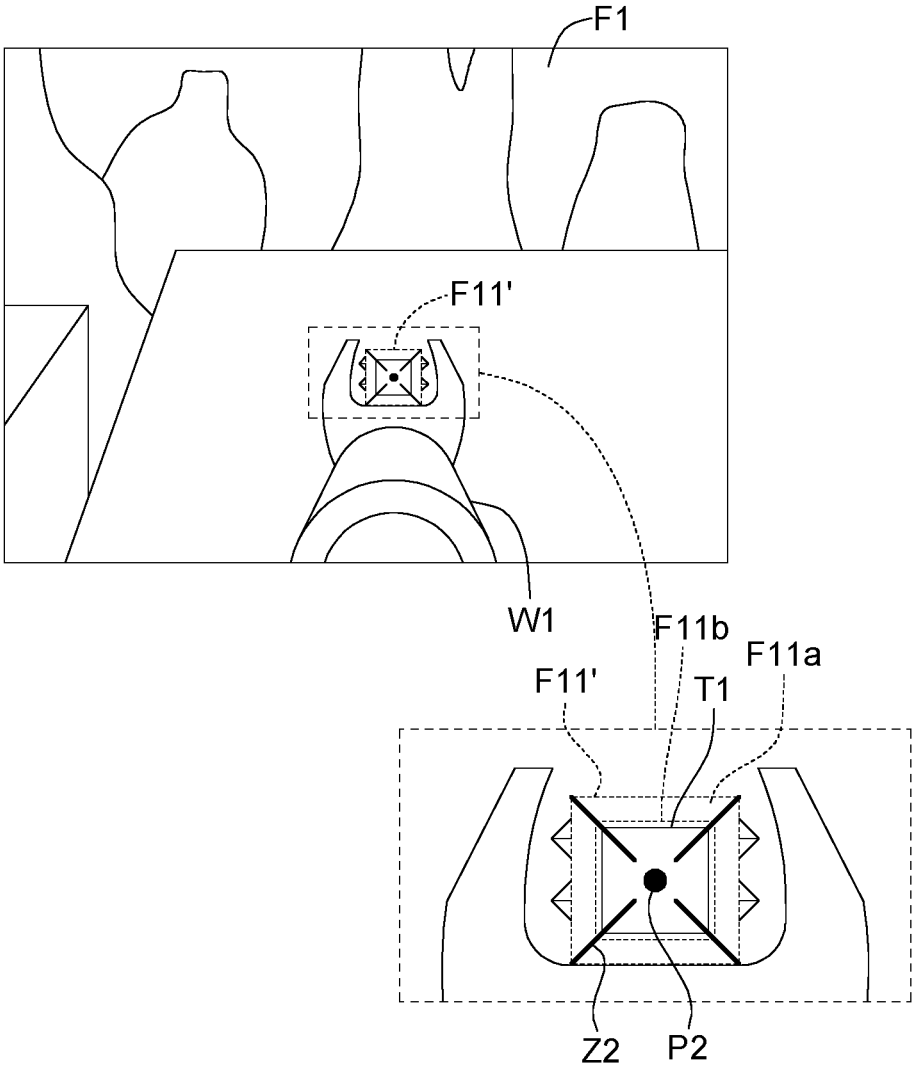
FIG. 6 shows a schematic diagram of another enlargement manner of the local portion F11 in FIG. 2.

Referring to FIG. 6, FIG. 6 shows a schematic diagram of another enlargement manner of the local portion F11 in FIG. 2. The local portion F11 based on the image signal S1 has a first crosshair pattern Z1 (shown in FIG. 3). The device processor 112 of the display device 110 could superimpose the second crosshair pattern Z2 on the local enlarged frame F11' and cover the enlarged first crosshair pattern Z1. The resolution of the second crosshair pattern Z2 is higher than the resolution of the local enlarged frame F11', so the second crosshair pattern Z2 could more clearly mark the target T1. In addition, depending on the shape and/or scope of the first crosshair pattern Z1 and the shape and/or scope of the second crosshair pattern Z2, the second crosshair pattern Z2 could cover a part or the entire of the first crosshair pattern Z1. In an embodiment, the second crosshair pattern Z2 could be entirely located in the middle range F11*b* (i.e., the second crosshair pattern Z2 is not located in the edge range F11*a*).

In an embodiment, the display parameter of the second crosshair pattern Z2 could be different from the display parameter of the first crosshair pattern Z1, wherein the display parameter here are, for example, contrast, color, and/or brightness. In addition, the edge range F11*a* and the middle range F11*b* of the local enlarged frame F11' in FIG. 6 could also have similar features of different scale ratio, and it will not be repeated here.

In terms of shape, the pattern of the second crosshair pattern Z2 and the pattern of the first crosshair pattern Z1 are, for example, the same or different. In the embodiment, the first crosshair pattern Z1 includes the cross pattern shown in the figure and the intersection center point of the crosshair (i.e., the crosshair position P1), and the second crosshair pattern Z2 also includes the cross pattern and the intersection center point of the crosshair (i.e., the crosshair position P2). When the second crosshair pattern Z2 could be entirely located in the middle region F11, the cross pattern of the second crosshair pattern Z2 approaches toward the crosshair position P2, for example.

As shown in FIG. 1, the input device 140 is, for example, a keyboard, a mouse, a joystick or other types of input interfaces. The input device 140 is connected to the second host port 123 of the host 120. The input device 140 could input a setting instruction C1 to the host 120, and the host 120 then transmits the setting instruction C1 to the display device 110. The setting instruction C1 could be generated based on the input to the input device 140 from the operator. The display device 110 controls the parameter of the local enlarged frame F11' according to the setting instruction C1, for example, whether to enable the enlarging mode, the magnification ratio setting of the local enlarged frame F11', whether to superimpose the second crosshair pattern Z2, the setting of the resolution of the second crosshair pattern Z2, whether to change the display parameter of target T1, the setting of the display parameter of the target T1 (for example, setting the contrast, color, and/or brightness of target T1), adjusting the position of the crosshair and/or setting of the speed value of cursor. In addition, the aforementioned setting instruction C1 could be transmitted to the display device 110 through the DDC/CI channel of the audio-visual transmission line 130.

In addition, after the host 120 could change the display parameter of the image signal S1 corresponding to the local portion F11 according to the setting instruction C1, the host 120 could generate the enlargement instruction C2 according to the setting instruction C1 and transmit the enlargement instruction C2 to the display device 110. The display device 110 enlarges the local portion F11 according to the enlargement instruction C2. In addition, the enlargement instruction C2 herein could be transmitted through the DDC/CI channel of the audio-visual transmission line 130.

In another embodiment, the enlargement instruction C2 could be input by the input device 140. For example, the operator could trigger an aiming key (not shown) on the input device 140, and then the input device 140 transmits an enlargement instruction C2 to the host 120, and the host 120 then instructs the display device 110 to enlarge the local portion F11. Similarly, if the setting instruction is to make the host 120 to lower the gun and not display the crosshair, the host 120 provides the instruction to the display device 110 to stop enlarging the image around the crosshair. As a result, "appearance of the crosshair" and "enlarging the local portion" could occur simultaneously occur or not display simultaneously. In addition, the enlargement instruction C2 could be generated based on an operator's input. In addition, as shown in FIG. 3, while the display device 110 enlarges the local portion F11, the device processor 112 could display an object image W1, for example, an aiming weapon (for example, a gun), according to the image signal S1.

As shown in FIG. 1, the host processor 121 of the host 120 could load an application program 124. The application program 124 could process the setting instruction C1 and/or the enlargement instruction C2 from the input device 140 and instruct the device processor 112 of the display device 110 to perform corresponding settings.

In another embodiment, the display device 110 could include an on-screen display (OSD) (not shown), and the operator could operate the OSD to input the setting instruction C1 and/or the enlargement instruction C2 without through the host 120 (for example, without through the application 124).

In summary, an embodiment of the present invention provides a display system, and its display device could perform a process of locally enlarging a frame, thereby reducing the burden on the host. In an embodiment, the display device 110 could directly process the display signal S1 and then display the processed display signal S1 to obtain the aforementioned the enlarging effect on the local portion. In another embodiment, the display device could capture the local portion F1 in FIG. 2 and then process the captured local portion F1 to obtain the aforementioned the enlarging effect on the local portion. In addition, the crosshair position of the local enlarged frame F11' and the center position of the local portion F11 substantially coincide (or overlap). In an embodiment, before enlarging, the center position of the local portion F11 could be a fixed position of the frame, for example, the center point. As a result, after enlarging, the local enlarged frame F11' appears at the center of the frame. In another embodiment, before enlarging, the center position of the local portion F11 could change with the cursor position. As a result, after enlarging, as the cursor position is different, the local enlarged frame F11' is dynamically presented at different positions. In addition, with the dynamic change of the frame, the content of the local portion F11 (or the local enlarged frame F11') at different time points also could be different.

While the invention has been described by way of example and in terms of the preferred embodiment (s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A display system, comprises:

a display device; and a host separately disposed from the display device, wherein the host is connected to the display device, wherein the host is configured to transmit an image signal to the display device, the display device is configured to display a frame according to the image signal; and an input device connected to the host, wherein when the input device inputs a setting instruction to the host, the host generates an enlargement instruction according to the setting instruction and transmits the enlargement instruction to the display device, the display device enlarges a local portion of the frame according to the enlargement instruction, the enlarged local portion has a first crosshair pattern;

wherein when the setting instruction is triggered by an aiming key on the input device and then the host instructs the display device to enlarge the local portion and to display a gun in the frame; and wherein when the setting instruction makes the host lower the gun, the host instructs the display device to stop enlarging image.

2. The display system according to claim 1, wherein the enlarged local portion comprises an edge region and a middle region, and scale ratio of the edge region is smaller than scale ratio of the middle region.

3. The display system according to claim 2, wherein the scale ratio of the enlarged local portion gradually increases from the edge region to the middle region.

4. The display system according to claim 1, wherein when the display device enlarges the local portion of the frame, the host lowers, in the image signal, a moving speed of a cursor in the enlarged local portion.

5. The display system according to claim 1, wherein the display device:

determine whether the local portion has a target; and when the local portion has the target, change display parameter of the target of the local enlarged frame.

6. The display system according to claim 5, wherein the display parameter is contrast, color or brightness.

7. The display system according to claim 1, wherein the display device is configured to:

capture the local portion of the frame;

enlarge the local portion; and superimpose the enlarged local portion on the local portion of the frame;

wherein the resolution of the enlarged local portion is lower than the resolution of an area outside the enlarged local portion.

8. The display system according to claim 1, wherein the local portion has a first crosshair position, and the display device is configured to:

superimpose a second crosshair position on the enlarged local portion and cover the enlarged first crosshair position;

wherein resolution of the second crosshair position is higher than resolution of the enlarged local portion.

9. A display method of a display system, the display system comprises a display device and a host separately disposed from the display device, and the display method comprises:

receiving, by the display device, an image signal from the host; and displaying, by the display device, a frame according to the image signal and enlarging, by the display device, a local portion of the frame;

wherein the display device is configured to:

capture the local portion of the frame;

enlarge the local portion; and superimpose the enlarged local portion on the local portion of the frame;

wherein the resolution of the enlarged local portion is lower than the resolution of an area outside the enlarged local portion.

10. The display method according to claim 9, wherein in the step of enlarging, by the display device, the local portion of the frame, the enlarged local portion comprises an edge region and a middle region, and scale ratio of the edge region is smaller than scale ratio of the middle region.

11. The display method according to claim 10, wherein in the step of enlarging, by the display device, the local portion of the frame, scale ratio of the enlarged local portion gradually increases from the edge region to the middle region.

12. The display method according to claim 9, further comprises:

inputting, by an input device, a setting instruction to the host;

according to the setting instruction, changing, by the host, display parameter corresponding to the local portion in the image signal;

according to the setting instruction, generating, by the host, an enlargement instruction and transmit, by the host, the enlargement instruction to the display device; and according to the enlargement instruction, enlarging, by the display device, the local portion.

13. The display method according to claim 9, further comprises:

when the host receives a setting instruction, transmitting, by the host, the setting instruction to the display device; and according to the setting instruction, controlling, by the display device, display parameter of the local enlarged frame.

14. A display system, comprises:

a display device;

a host connected to the display device with an audio-visual transmission line, wherein the host is configured to transmit an image signal to the display device through the audio-visual transmission line, the display device is configured to display a frame according to the image signal, and the frame has a first crosshair pattern; and an input device connected to the host and configured to input a setting instruction to the host, wherein the host transmit the setting instruction to the display device through the audio-visual transmission line, the display device is configured to enlarge a local portion according to the setting instruction, and the local portion has a second crosshair pattern.

15. The display system according to claim 14, wherein the first crosshair pattern has a crosshair position, and the host is configured to transmit the crosshair position to the display device with the audio-visual transmission line.

16. The display system according to claim 14, wherein the display device is configured to:

superimpose a second crosshair position on the enlarged local portion and cover the enlarged first crosshair position;

wherein resolution of the second crosshair position is higher than resolution of the enlarged local portion.

17. The display system according to claim 14, wherein the local portion comprises an edge region and a middle region, scale ratio of the edge region is smaller than scale ratio of the middle region, and the middle region comprises the first crosshair pattern.

18. The display system according to claim 14, wherein the first crosshair pattern has a crosshair position, and the crosshair position is allowed to be adjusted by a setting interface of the display device.

19. A display system, comprises:

a display device; and a host separately disposed from the display device, wherein the host is connected to the display device, wherein the host is configured to transmit an image signal to the display device, the display device is configured to display a frame according to the image signal; and an input device connected to the host, wherein when the input device inputs a setting instruction to the host, the host generates an enlargement instruction according to the setting instruction and transmits the enlargement instruction to the display device, the display device enlarges a local portion of the frame according to the enlargement instruction, the enlarged local portion has a first crosshair pattern;

wherein when the display device enlarges the local portion of the frame, the host lowers, in the image signal, a moving speed of a cursor in the enlarged local portion.

* * * * *